United States Patent [19]

Koenig et al.

[11] 4,082,506

[45] Apr. 4, 1978

[54] PRINTING FORMULATIONS

[75] Inventors: Harvey Steven Koenig, Charleston; Russell Harold Raines, Nitro, both of W. Va.

[73] Assignee: Union Carbide Corporation, New York, N.Y.

[21] Appl. No.: 622,614

[22] Filed: Oct. 15, 1975

[51] Int. Cl.[2] ..... C09B 67/00; D06D 1/46

[52] U.S. Cl. ..... 8/91; 8/62

[58] Field of Search ..... 8/91, 93, 62, 63; 252/DIG. 1; 260/615 B

[56] References Cited

U.S. PATENT DOCUMENTS

| | | | |
|---|---|---|---|
| 1,970,578 | 8/1934 | Schoeller et al. | 252/DIG. 1 |
| 2,508,035 | 5/1950 | Kosmin | 260/615 R |
| 2,508,036 | 5/1950 | Kosmin | 260/615 R |
| 2,617,830 | 11/1952 | Kosmin | 260/615 R |
| 2,671,115 | 3/1954 | Kosmin | 260/615 R |
| 2,671,116 | 3/1954 | Kosmin | 260/615 R |
| 3,472,670 | 10/1969 | Nobs | 8/91 |
| 3,510,244 | 5/1970 | Schlagenhaufen et al. | 8/91 |

FOREIGN PATENT DOCUMENTS

| | | | |
|---|---|---|---|
| 750,150 | 6/1956 | United Kingdom | 8/91 |

OTHER PUBLICATIONS

Surface Active Agents & Detergents, 1958, vol. II, Schwartz et al., Interscience Publ. Inc., p. 594.

*Primary Examiner*—William E. Schulz
*Attorney, Agent, or Firm*—Francis M. Fazio

[57] ABSTRACT

A formulation for use in the printing of fabrics or carpets comprising a thickener such as hydroxyalkyl cellulose, an ethylene oxide adduct of a mixture of $C_{11}$ to $C_{15}$ linear secondary alcohols, a dyestuff and water.

3 Claims, No Drawings

PRINTING FORMULATIONS

BACKGROUND OF THE INVENTION

In the printing of natural or synthetic textile fabrics, the use of flat-bed and rotary screen printing has become quite prevalent. These procedures have imposed stringent performance requirements on the print paste formulations employed. These must be readily applicable to the fabric or carpet to produce a clearly defined pattern and must not clog or form any appreciable residue on the screens or roller squeegees since such residues interfere with proper application of the dyestuff and necessitate interruption in the production operations in order to clean the screens.

SUMMARY OF THE INVENTION

The instant invention comprises a formulation containing a thickener such as hydroxyalkyl cellulose, an ethylene oxide adduct of a mixture of $C_{11}$ to $C_{15}$ linear secondary alcohols, said adduct having from 2 to 15 ethyleneoxy units in the molecule, a dyestuff and water as the principle components. The combination of the hydroxyalkyl cellulose and the specifically defined ethylene oxide adduct forms a superior print paste in formulations used in the flat-bed or rotary screen printing of natural or synthetic fabrics or carpets.

DESCRIPTION OF THE INVENTION

Among the methods employed in the printing of fabrics and carpets are the block printing and roller printing screen processes. In these operations a screen defining the pattern is positioned over the fabric or carpet and the dye paste is forced through the screen by a squeegee drawn across the screen. This procedure is repeated with following sequences of screens and differently colored print pastes to achieve the desired colored pattern on the substrate. In the block printing method the pattern is applied using a series of flat screens in sequence and in the roller printing method a series of rollers defining different portions of the final design or pattern are used in sequence. In each instance synchronization is important.

In these dyeing procedures it is important that the outlines of the patterns be clearly defined, that the dyestuff penetrate through the carpet completely and uniformly and that the screens not be plugged by deposits of solid or gel material to the degree that uneven or improper transfer of dye or print paste to the fabric or carpet substrate being dyed will result. The improved print pastes of this invention can be used without the problems often encountered and result in the manufacture of commercially acceptable dyed or printed carpets.

The improved print paste formulations of this invention are produced by mixing together the specified components at the proper concentrations. The hydroxyalkyl cellulose compounds are the preferred thickeners; there are well known in the art and include for example, hydroxyethyl cellulose, hydroxypropyl cellulose, hydroxyethyl methylcellulose and hydroxypropyl methylcellulose. If desired, one can also use galactomannans, alginates, or other known thickeners. The preferred thickener is hydroxyethyl cellulose having at least two hydroxyethyl groups for each anhydroglucose unit.

The formulated compositions of this invention have a Brookfield viscosity at 25° C. of from 50 cps. to 15,000 cps. The particular viscosity required will depend upon the structure of the carpet that is to be dyed and the design to be imparted to it. The concentration of the thickener in the formulation can vary from 0.05 to 15 weight percent, preferably from 0.5 to 4 weight percent.

The second component of the print formulation is an ethylene oxide adduct of a mixture of $C_{11}$ to $C_{15}$ linear secondary alcohols. These adducts contain an average of from 2 to 15 ethyleneoxy units in the molecule with the preferred adduct having an average of about 3 ethyleneoxy units in the molecule. The concentration of this adduct component in the print paste formulation can vary from 0.1 to 5 weight percent, preferably from 0.5 to 1 weight percent.

The concentration of the dye in the formulation will vary dependent upon the particular dyestuff selected and the desires of the practitioner. Generally, it will be from about 0.05 to 2 weight percent. The dyestuffs most frequently used and preferred are the acid or metalized dyes; many of these are known and commercially available and an extensive enumeration thereof is not necessary for one skilled in the art to clearly understand and reproduce the herein claimed invention. Nevertheless, the following specific dyestuffs are identified as suitable for use in this invention, Acid Yellow 151 (C.I. 13906), Acid Orange 60 (C.I. i8732), Acid Orange 50 (C.I. 13150), Acid Red 151 (C.I. 26900), Acid Red 114 (C.I. 23635), Acid Violet 11 (C.I. 17060), Acid Blue 25 (C.I. 62055), Acid Blue 27 (C.I. 61530), Acid Blue 40 (C.I. 62125), Acid Black 52 (C.I. 15711). Any of the known dyes known to be suitable can be used, the above is merely an illustration of a limited number of the most frequently used dyes.

The print paste formulations of this invention can also contain any of the other known additives conventionally used in the art, such as dye fixatives, antistats, bactericides, fungicides, and the like. These are present in the conventional amounts known to those skilled in the art and do not require further identification therein.

The print paste compositions are readily produced by mixing the components together until a uniform mixture is obtained. It is important, however, that with the hydroxyalkyl cellulose, both it and the ethylene oxide adduct of the $C_{11}$ to $C_{15}$ mixed linear secondary alcohols be completely mixed in at least a portion of the water before the dyestuff is added thereto. After addition of the dyestuff to this preliminary mixture additional water can be added to bring the print paste to the desired concentration. This order of addition is important because addition of the dyestuff to the hydroxyalkyl cellulose and water mixture alone can result in gelation of the system. However, addition of the dyestuff to the hydroxyalkyl cellulose in water having the ethylene oxide adduct of the mixed $C_{11}$ to $C_{15}$ linear secondary alcohols also present produces a smooth, homogeneous print paste.

Compositions of this invention were shown to have several advantages. Among the obvious improvements were that dye compatibility, defoaming and screen release were noted. It was also noted that at low pH value, from about 2 to 5, acid dyes showed less of a tendency to precipitate out of the composition. In addition, in the dyeing of nylon substrates, the composition appears to produce clearer and sharper dye prints. Another improvement noted was increased dye intensity or color yield.

In some instances, some degree of dye precipitation was observed when high concentrations of neutral metalized dyes were used. However, by proper selection of dye concentration, this is not an insurmountable problem.

The dye compositions of this invention can be used to dye shag carpets having a short or full pile, plush carpets, level loop carpets or conventional fabrics. The methods employed are well known to those skilled in the art as are the flat-bed and rotary screen techniques and apparatus required in these methods. The following examples serve to illustrate the invention.

EXAMPLE 1

There was added 3.6 grams ofhydroxyethyl cellulose having an average of two hydroxyethyl groups per anhydroglucose unit to 250 grams of water and the mixture was stirred until a thick, uniform paste was obtained. To this there was added 4 grams of the ethylene oxide adduct of mixed $C_{11}$ to $C_{15}$ linear secondary alcohols having an average of 3 ethyleneoxy units.

A separate solution was prepared containing 15.36 grams of Acid Yellow 151, 7.68 grams of Acid Orange 60, 1.92 grams of Acid Blue 25 and 775 grams of water. A 100 gram portion of this dye solution was added to the paste described above and stirred to homogeneity. To the brown print paste there was added 8 grams of formic acid as dye fixative and water to make 400 grams total weight and the composition was used to print a nylon level loop carpet using a laboratory model flat-bed screen. Printing and cure were accomplished by the conventional procedures. The print paste had a viscosity of 2,850 cps. and produced a uniform, clearly defined pattern on the carpet.

Similarly, print paste compositions were producing using the same dye solution but using different ethylene oxide adducts in preparing the pastes. The ethylene oxide adducts of the $C_{11}$ to $C_{15}$ alcohols varied in the average number of ethyleneoxy units in the molecule, specifically 1.7, 2.3, 2.7, 3.3 and 5.0 units. The brown print pastes had, respectively, viscosities of 2,750, 2,750, 2,750, 2,500 and 3,250; they all printed uniform, clearly defined patterns, differing slightly in color yield.

EXAMPLE 2

In a manner similar to that described in Example 1, a paste was prepared using 3.8 grams of the same hydroxyethyl cellulose.

A dyestuff solution was prepared containing 3 grams of Acid Blue 25 and 330 grams of water. A 100 grams portion of the dye solution was added to the above print paste followed by 8 grams of formic acid and water to make 400 grams total weight. This blue print paste had a viscosity of 2,750 cps. It readily dyed nylon level loop carpet by the procedure described in Example 1.

EXAMPLE 3

Following the procedure described in Example 2, a print paste was produced using a 100 grams portion of a dye solution containing 1.2 grams of Acid Yellow 151, 1.2 grams of Acid Yellow 49 and 330 grams of water. The yellow print paste has a viscosity of 2,750 cps.; it readily dyed level loop nylon carpet to uniform, clearly defined patterns.

EXAMPLE 4

Following the procedure described in Example 2, a print paste was produced using a 100 grams portion of a dye solution containing 3.69 grams of Acid Yellow 151, 2.88 grams of Acid Red 114, 0.03 gram of Acid Blue 25 and 330 grams of water. The red print paste had a viscosity of 3,500 cps. It readily dyed nylon carpet by the procedure of Example 1, producing a clear, uniform pattern.

Omission of the ethylene oxide adduct of the $C_{11}$ to $C_{15}$ mixed linear alcohols from the print paste results in a gelatinous mass that cannot be used.

EXAMPLE 5

Following the procedure described in Example 1, a brown print paste formulation was produced. In this instance the ethylene oxide adduct of the mixed alcohols had an average of 9 ethyleneoxy groups. Further, it was necessary that 4 grams of 2-ethylhexanol defoamer be added to the print paste to control foam formation during printing. The generation of foam has been observed when using the ethylene oxide adducts of the mixed alcohols having more than 3 ethylenoxy units; in such instance a defoamer can be used without detriment.

What is claimed is:

1. A print paste composition consisting essentially of
(A) from 0.05 to 15 weight percent of a hydroxyalkyl cellulose,
(B) from 0.1 to 5 weight percent of an ethylene oxide adduct of a mixture of $C_{11}$ to $C_{15}$ linear secondary alcohols, said adduct having from 2 to 15 ethyleneoxy units in the molecule,
(C) a dyestuff, and
(D) water as the balance

2. A print paste composition as claimed in claim 1 wherein (A) is hydroxyethyl cellulose.

3. A print paste composition as claimed in claim 2, wherein (B) is the ethylene oxide adduct of a mixture of $C_{11}$ to $C_{15}$ linear secondary alcohols having an average of 3 ethyleneoxy units.

* * * * *